US010196805B2

(12) United States Patent
Lammel et al.

(10) Patent No.: US 10,196,805 B2
(45) Date of Patent: Feb. 5, 2019

(54) TOILET WITH PERSONAL DOUCHE INTEGRATED INTO FLUSHING WATER DISTRIBUTOR

(71) Applicant: TECE GmbH, Emsdetten (DE)

(72) Inventors: Michael Lammel, Aachen (DE); Matthias Stockel, Rheine (DE); Martin Krabbe, Altenberge (DE); André Meiermann, Münster (DE); Uwe Koziol, Schwerte (DE)

(73) Assignee: TECE GmbH, Emsdetten (DE)

( * ) Notice: Subject to any disclaimer, the term of this patent is extended or adjusted under 35 U.S.C. 154(b) by 292 days.

(21) Appl. No.: 14/784,819

(22) PCT Filed: Apr. 17, 2014

(86) PCT No.: PCT/EP2014/057977
§ 371 (c)(1),
(2) Date: Oct. 15, 2015

(87) PCT Pub. No.: WO2014/170465
PCT Pub. Date: Oct. 23, 2014

(65) Prior Publication Data

US 2016/0186421 A1 Jun. 30, 2016

(30) Foreign Application Priority Data

Apr. 18, 2013 (DE) ..... 10 2013 207 053
Oct. 15, 2013 (DE) ..... 20 2013 104 672 U
Nov. 28, 2013 (DE) ..... 20 2013 105 421 U

(51) Int. Cl.
*E03D 9/08* (2006.01)

(52) U.S. Cl.
CPC ..... *E03D 9/08* (2013.01); *E03D 2201/40* (2013.01)

(58) Field of Classification Search
USPC ..... 4/420.55, 505, 420.1, 420.5, 420.4
See application file for complete search history.

(56) References Cited

U.S. PATENT DOCUMENTS 3,594,827 A 7/1971 Giacosa et al.
4,136,407 A 1/1979 Maurer
(Continued)

FOREIGN PATENT DOCUMENTS

DE 19644865 A1 4/1998
DE 102005029609 A1 1/2007
(Continued)

OTHER PUBLICATIONS

International Search Report (with English translation) and Written Opinion dated Jul. 31, 2014 in International Application No. PCT/EP2014/057977.

(Continued)

*Primary Examiner* — Lauren Crane
(74) *Attorney, Agent, or Firm* — Panitch Schwarze Belisario & Nadel LLP

(57) ABSTRACT

A douche toilet is provided having a toilet bowl (2) including a flushing water inlet opening (2*a*) for supplying flushing water into a flushing chamber (4) for a flushing operation and a waste water opening for flushing waste water out of the toilet bowl (2), a flushing water distributor (10) for distributing the flushing water around the flushing chamber (4), and a douche lance (10*a*) for washing the user in the anal or genital region. To simplify the structure of the douche toilet, in particular to make cleaning thereof easier, the douche lance (10*a*) is integrated into the flushing water distributor (10).

18 Claims, 8 Drawing Sheets

(56) References Cited

U.S. PATENT DOCUMENTS

| | | | | |
|---|---|---|---|---|
| 5,025,510 | A * | 6/1991 | Basile | E03D 9/085 248/309.4 |
| 5,715,544 | A * | 2/1998 | Huffman | E03D 11/13 4/420 |
| 5,742,952 | A | 4/1998 | Huang | |
| 7,971,284 | B2 | 7/2011 | Pessel et al. | |

FOREIGN PATENT DOCUMENTS

| | | | | |
|---|---|---|---|---|
| DE | 202012005145 | U1 | 8/2013 | |
| EP | 0293356 | A1 | 11/1988 | |
| EP | 0519885 | A1 * | 12/1992 | E03D 9/08 |
| EP | 0530965 | A1 | 3/1993 | |
| EP | 2281957 | A3 | 4/2011 | |
| EP | 2447426 | A1 | 5/2012 | |
| EP | 1491692 | B1 | 6/2012 | |
| JP | H07224453 | A | 8/1995 | |
| WO | 9525205 | A1 | 9/1995 | |
| WO | 2012051723 | A1 | 4/2012 | |

OTHER PUBLICATIONS

Office Action dated Feb. 12, 2014 in DE Application No. 102013207053.5.

International Preliminary Report on Patentability dated Oct. 29, 2015 in International Application No. PCT/EP2014/057977.

* cited by examiner

TOILET WITH PERSONAL DOUCHE INTEGRATED INTO FLUSHING WATER DISTRIBUTOR

CROSS-REFERENCE TO RELATED APPLICATIONS

This application is a Section 371 of International Application No. PCT/EP2014/057977, filed Apr. 17, 2014 which was published in the German language on Oct. 23, 2014 under International Publication No. WO 2014/170645 A1, and the disclosure of which is incorporated herein by reference.

BACKGROUND OF THE INVENTION

The invention concerns a douche toilet comprising a toilet bowl including a flushing water inlet opening for the supply of flushing water into a flushing chamber defined by the toilet bowl for a flushing operation and a waste water opening or a drain connection, preferably with an odor barrier, particularly preferably in the form of a toilet siphon, for flushing waste water out of the toilet bowl, a flushing water distributor for distributing the flushing water in the flushing chamber, and a douche lance which is extendable for carrying out a personal cleaning operation for a user. The invention further concerns a flushing water distributor for such a douche toilet as well as a toilet bowl, preferably comprising ceramic.

Usually douche toilets of that kind are fixed in freely hanging relationship on a wall disposed therebehind and in that respect are referred to as wall-hung toilets or simply wall toilets. That fixing is effected with the interposition of a flushing pipe connector with the flushing pipe carrying flushing water and a waste water connector with the waste water pipe in the wall. The flushing pipe and waste water connectors which function as transitional portions are shortened to the necessary dimension by the installer upon fitting.

"Flushing water" in accordance with the invention is the flushing or drinking water used for flushing out the flushing chamber of the toilet bowl and "cleaning water" is the flushing or drinking water which flows through the douche lance for personal cleaning of the anal and/or genital parts of a user.

Douche toilets of that kind are frequently to be found in the Asian area and are now also widespread in Europe. A douche toilet in effect combines the functions of a regular toilet and the bidet in one sanitary appliance or sanitary unit, thereby affording novel creative design options in the bathroom. For the purposes of personal cleaning which can be effected by sitting on the toilet bowl, it is only necessary to operate an actuating unit so that the water pipe of the douche lance, that usually carries drinking water, supplies water.

STATE OF THE ART

There are two generally different approaches for implementing a douche toilet or douche closet, namely on-top attachment devices and integrated douche toilet ceramic pans.

Attachment devices:

In the case of a classic attachment device, also referred to as a douche toilet attachment, the complete technical arrangement is disposed above the toilet bowl. The toilet seat including the toilet lid and the seat ring is connected to the toilet bowl by way of fixing screws. Otherwise there is no connection between the toilet bowl and the technical equipment in the technical area. The connecting pipes can either extend visibly beside the toilet bowl or can be passed invisibly through the bowl behind the wall.

The advantage of attachment devices is that the technical engineering equipment required for the douche toilet is separate from the ceramic pan. By virtue of the integration of electrical, mechanical and hydraulic components the susceptibility and consequently the complaints level in the case of douche toilets is really high. In the case of a defect in the attachment device therefore usually the complete device with the integrated technical equipment has to be exchanged for a new or repaired device. In addition, the separation of technical equipment and bowl permits a greater degree of freedom in terms of design of the toilet bowl. Thus, various attachment devices can be used, adapted to different toilet bowls.

The attachment devices are generally produced in a different production facility from the actual toilet bowl and the attachment devices and the bowl are different sales units which are fitted together for the first time at the building site. That affords marked advantages in terms of distribution, quantity planning and storage. In addition, as an alternative to the douche toilet fitment, it is also possible to fit a conventional toilet seat. The bowl can thus be put to more universal use.

On the other hand, attachment devices also suffer from disadvantages. The technical equipment requires space which has to be integrated either in the toilet seat, beside the seat ring, or in the lid. The attachment device therefore has to carry all the technical equipment of the douche toilet, so that these structures are relatively large and prominent. In addition, the actual toilet bowl has to be markedly longer to provide sufficient space for the technical assembly. The greatest disadvantage of attachment devices, however, is the numerous joints and edges which are susceptible to dirt and which occur at the transitional region between the technical assembly and the ceramic pan. Even high-grade douche toilets do not provide a solution to that systematic problem. Often the attachment device with the integrated technical equipment has to be removed for cleaning purposes, which however is not always easy. The attachment device is then generally also connected to a power and water line which have to be separated from each other for the cleaning operation. In the case of some designs the attachment device can only be removed by releasing fixing screws. Those structures basically do not provide any possibility of cleaning the joints at the separation or joint locations between the attachment device and the toilet bowl because, when the fixing screws are released from the toilet seat which is connected to the attachment device, the technical assembly also has to be dismantled, the supply lines for water and power thereof then being exposed. In that respect, that operation is to be performed only by trained maintenance personnel and cannot in any way be carried out by the user, in the context of a cleaning operation.

A particular attachment device is described in European patent application publication EP 2 447 426 A1. In that case, a technical assembly projects into the portion between the wall and the ceramic pan as, when cleaning the edge between the technical assembly and the ceramic pan, the installation hole would be opened, in which case once again the supply lines are exposed. In that respect, this structure also does not provide for removal of the technical assembly for the purposes of cleaning by the user; that can only be done by skilled personnel. In that respect this device always involves the unwanted edges which easily become dirty. Dirt problems arise with that structure in particular by virtue of urinating in the standing position.

In recent times, toilet bowls without a peripherally extending flushing edge for the distribution of the flushing water are increasingly used, also being referred to as rimless or rim-free pans. These rim-free pans are easier to clean by virtue of the lack of a flushing edge in the flushing chamber. When, however, those pans are then provided with an attachment device, in particular unwanted dirt-attracting edges are the result, which there is precisely a wish to avoid. The market is here urgently looking for a simple solution.

Integrated douche toilet bowls:

Integrated douche toilet bowls are sometimes also referred to as "intelligent" toilets and combine all functions in one unit, that is to say the function of the douche toilet and the toilet bowl, so that the bowl and the technical assembly are always exactly matched to each other. In the typical Asian pedestal toilet versions a flushing cistern is also integrated. As these involve siphon toilets the flushing cistern can be formed very low directly on the toilet bowl. The technical assembly for the douche toilet is preferably disposed behind plastic shields on or behind the ceramic pan.

Wall-hung toilets are of greater significance in Europe. There are, for example, wall-hung toilets from Geberit (bearing the product identification "Aquaclean 8000") and Closomat (bearing the product identification "Aquaris"), in which the technical assembly is arranged completely beneath the bowl. It will be noted, however, that the rear region of the ceramic pan is higher than in the case of a regular toilet ceramic pan. That arrangement has the advantage that no plastic cover has to be provided in the upper region of the toilet, that is towards the user, and therefore these appliances only include the ceramic pan and the toilet seat fixed thereon so that everything is good and easy to clean. As there are no or few material transitions, edges or joints, the ceramic pan can be easily cleaned when soiled. Disposed in the visible region are only the douche toilet lance and possibly a lance for a blower or simply an air opening. The arrangement of the technical assembly in the toilet bowl means however that these structures are relatively large and heavy, which is a problem in particular from design aspects. This also means that the toilet bowls are heavy to fit and sometimes require reinforcements in a dry wall to which the toilet bowl is fixed.

In accordance with DIN-EN 14055 the flushing pipe connector is required by standard to be of a diameter of between 32 and 45 mm. In the case of a wall-hung toilet that is of a minimum inside diameter of 39 mm. A douche lance is of a diameter of between about 14 and 20 mm. Inclusive of the lance housing for receiving the douche toilet lance, that gives a diameter of between about 22 and 28 mm. A douche lance cannot therefore be readily integrated into a flushing pipe like a thin tube in accordance with International patent application Publication No. WO 2012/051723 A1. The remaining annular gap would excessively greatly reduce the pressure of the flushing water, which in turn leads to inadequate flushing of the pan. A further problem with the arrangement disclosed in WO 2012/051723 A1 is fitment. More specifically, the tube has to be passed through the flushing pipe into the cistern and can only there be connected to the water pipe. What still operates in the case of a surface-mounted cistern as in WO 2012/051723 A1 can scarcely still be implemented in a wall-mounted cistern. The valve for the actuation of the bidet function is no longer accessible in the case of a wall-mounted flushing cistern.

In known toilet bowls the flushing water is usually supplied from an external flushing cistern through a central flushing pipe arranged on the central axis of the toilet ceramic pan, to a flushing water opening in the toilet bowl. The arrangement of the flushing pipe is determined by the position in the flushing cistern. It is standardized by DIN-EN 33. That standard also specifies the diameters of the flushing water feed. The dimensions of flushing pipes are defined in the flushing cistern standard DIN-EN 14055:2011-02.

If there were a wish to integrate a bidet function in a toilet bowl, the question arises of the possible position of the lance within the restricted installation space in the toilet pan. A central position for the douche lance is desirable for cleaning purposes, but it inevitably collides with the usual space for the flushing water supply.

U.S. Pat. No. 4,136,407 discloses arranging the lance beneath the flushing water supply. The lateral position thereof produces an asymmetrical configuration which has an unattractive effect and in that respect is not suitable for a harmonic design. The douche toilet lance or the lance is arranged beneath the flushing water supply in order not to interrupt the flushing flow within the toilet bowl. A lower position within the bowl or in the flushing space is however generally undesirable because the douche lance can be soiled by water spraying up out of the siphon region at the lower end of the toilet bowl.

A further solution is disclosed in EP 2 447 426 A1 which basically provides for arranging the lance above the flushing water feed. That solution is also very widespread and usually includes an attachment device with the disadvantages linked thereto, that is to say in particular corners and edges which are susceptible to soiling between the pan and the attachment device. In the solutions which are integrated in the pan, for example in accordance with European Patent EP 1 491 692 B1, in particular FIG. 2, the toilet bowl is increased in height in the rear region, which is also unwanted for design reasons. In addition the flushing water feed in that design configuration is inevitably arranged at a lower position within the toilet pan, which involves disadvantages in regard to flushing out the pan, in particular in the case of the so-called "rimless" pans, because the flushing water does not flow as far as the front edge of the toilet pan or the flushing chamber, but flows away downwardly before that. In that case only an inadequate surface flushing effect is achieved.

In German Utility Model DE 20 2012 005 145 U1 the flushing water feed is arranged tangentially relative to the lance. That tangential inflow of the flushing water provides a free space in the middle of the flushing chamber, which can be used for passing the flushing water therethrough. That in turn however gives an asymmetrical configuration which is unattractive from the point of view of design. In addition, a plurality of openings are required in the flushing chamber, which also have to be sealed off. By virtue of deflection of the flushing water from the standardized central position of the water feed to the tangential inflow position the pan is also of a longer structure. In practice however the wish is for toilet bowls which are as short as possible as the installation space in bathrooms and toilet closets is generally restricted.

In U.S. Pat. No. 3,594,827 the douche lance is arranged between the flushing water feed and the waste water connection, which is also problematic because the lance is arranged too low in the flushing chamber (this arrangement is not hygienic). In addition in that case, two sealing arrangements are also required within the pan.

WO 2012/051723 A1 uses a special component for diverting the flushing water feed at two sides. That diversion component takes up a great deal of space. The length of a wall-hung pan is in accordance with standard usually between 520-560 mm; a typical widespread dimension is nowadays 530 mm. A pan in accordance with WO 2012/051723 A1, in contrast with the technical unit arranged at the rear side between the pan and the wall for receiving the diversion component, involves a protrusion distance of a minimum of 625 mm, which is not suitable for many smaller bathrooms.

In German patent publication DE 196 44 865 a flushing nozzle which cannot be extended is guided within the flushing water feed into the toilet flushing edge. That is a widespread technology for toilets in Turkey. In that case, a 6-8 mm thick plastic hose is passed through the flushing pipe to the flushing edge and connected to a nozzle screwed in the flushing edge. In that solution the water is not passed under pressure to the position to be cleaned, as is usual in the case of douche toilets, by way of an extendable lance. Rather, water is sprayed from the rear against the bottom of the user. With that solution cleaning is effected with the assistance of the hand. That is certainly usual in Arab countries and India. In cultural circles in which washing after using the toilet is not culturally embedded, such a course of action has rather a repulsive effect, for example in Europe and Asia. Here, solutions are required, which take the cleaning water to precisely the correct position in targeted fashion.

BRIEF SUMMARY OF THE INVENTION

Technical Problem (Object)

Taking the state of the art set forth in the opening part of this specification as the basic starting point, the object of the invention is to at least partially avoid those disadvantages and, in particular, to provide a douche toilet which is easier to clean and which is of a simpler structure and compact.

Invention

According to the invention, the flushing water distributor is in the form of an integral component which simultaneously performs the function of delivering flushing water and the douche toilet functions. This is achieved in that the flushing water distributor has at the same time a douche lance (personal cleaning device), which can be extended from a retracted rest position into a cleaning position for personal cleaning.

The invention resolves the above-discussed problems in the state of the art by a novel combination component, which unites the function of the douche toilet lance housing with the function of providing the flushing water for regular flushing in one compact component, and which is fitted between the toilet bowl and the flushing pipe connector. Directed to the wall the combination component is preferably of an enlarged diameter in comparison with a regular flushing pipe connector, preferably involving a diameter of about 55 mm in accordance with DIN-EN 33 for a flushing water opening of a wall-hung toilet bowl. It can thus be mounted with all commercially available flush-mounted cisterns and flushing pipe connectors. This inside diameter which is increased in accordance with the invention, by comparison, provides sufficient space for positioning the douche lance. When the douche lance is arranged horizontally there is a free cross-section of 1923 $mm^2$, whereas a flushing pipe connector known from the state of the art would only have a free cross-section of 1195 $mm^2$.

The combination component according to an embodiment of the invention therefore affords sufficient space for the lance housing also to be positioned at an angle of about 15° relative to the horizontal without limiting the free cross-section in comparison with the flushing pipe disposed in front thereof. The slight inclined positioning of the douche lance affords the optimum position for the water opening when using the bidet function. The flushing water for regular flushing in contrast can flow past at both sides and beneath the integrated lance housing. By virtue of the slightly inclined arrangement of the douche lance including housing within the novel component, the lance tip in the extended cleaning position is in an optimum position at between about 40 and 50 mm below the upper edge of the toilet opening. Combined with the slightly inclined position, that gives a lance position which, however, in the extended condition is still sufficiently far away from the bottom of the user and therefore is never directly touching it. As the inclined position is substantially flatter than in the case of the attachment devices known from the state of the art, the visually unattractive rear increase in height of a douche toilet can be completely eliminated. Integration of the douche lance into the toilet pan completely eliminates transitions which are otherwise present and which are difficult to clean between the douche toilet fitments and the toilet bowl. In the case of an embodiment of the invention, only a flat rosette with a central through opening for the lance is required at the rear side of the toilet bowl (with or without rim).

The mounting region of the combination component in the toilet bowl is preferably of a circular configuration, so that it can be easily installed and sealed off (sealed in place) with a multi-lip seal in the toilet bowl. Manufacture and fitting are considerably simplified in that respect because a seal is required only at one location.

Preferably, the combination component is of an overall length of 163 mm between the front edge of the lance in the retracted condition and the rear end which in the installed position is directed to the wall so that it is very compact and thus does not require relatively long ceramic components or fitments; rather, it can also be integrated in existing toilet bowls or ceramic pans when a suitable opening is retro-equipped using a glass cutter. The combination component even makes it possible for the first time to manufacture douche toilet ceramic pans of an overall length of only 530 mm.

Finally, it can also be pre-installed at the factory, so that the installer is not faced with any new installation procedures.

Preferably, in this embodiment the lance housing is thus arranged within the flushing water connection in such a way that the rear part projects out of the combination component, to which the water supply of the douche lance can be connected, preferably a hose nipple being provided for that purpose on the combination component. The douche water conduit therefore does not have to be passed through the flushing pipe connector into the cistern as in the state of the art. Rather it is possible for the entire douche toilet technical assembly to be arranged within the toilet bowl. That permits simple installation of the douche toilet. In the installation procedure only the water supply and possibly an optional power supply have to be connected.

In a particularly advantageous embodiment, the lance housing is of such a configuration that the lance and the return spring, for the purposes of assembly or maintenance, can be completely removed forwardly. If the lance, the spring or a seal is to be maintained, it can be removed completely forwardly from the lance housing. For that purpose, a shield cap which is usually provided is removed so that the holding nut disposed underneath it can be released. The lance can then be pulled forwardly out of the lance housing, together with the spring and seals. All that is done without dismantling the toilet pan.

By virtue of this configuration, all the functional modules for operation of the douche toilet (as for example a filter, pumps, a flow heater, electronic control systems, valves, safeguard means against backflow to the drinking water supply system in accordance with DIN-EN 1717, an air pump or a fan, a dryer unit, a water storage means, a decalcification unit, and so forth) can thus be completely separated from the toilet bowl and are thus also independent of same, because they are in the wall behind the toilet bowl.

That wall can be in the form of a solid built wall with a maintenance opening for receiving the functional modules. Frequently, however, the wall is nowadays in the form of a dry wall which is adapted to the respective installation situation and which includes assembly supports composed of assembly profile members for forming a receiving space to which cover panels are fixed at the outside. At any event, the configuration according to the invention provides that the design of the toilet bowl is completely independent of the functional modules. The functional modules are assembled in a so-called "technical box" in a technical region in the wall behind the toilet bowl. Disposed in the toilet bowl are only the flushing water distributor with the douche lance and possibly a sensor for user detection and optionally an outlet opening for the warm air from the dryer.

The douche toilet according to embodiments of the invention therefore looks like a "standard pan," but implements all functionalities of a modern douche toilet, because the flushing water distributor, which includes the douche lance, is fixed to the toilet bowl or is fitted into the flushing water inlet opening, which is present in any case, of the toilet bowl. There is therefore no longer any need for an unattractive and massive technical assembly behind the toilet in front of the wall or other plastic covers in the visible region. The term "flushing water inlet opening" in accordance with the invention is used to denote any opening in the toilet bowl through which flushing and/or cleaning water can pass into same. That flushing water inlet opening can also include means for holding the flushing water distributor in the installation position, preferably a seat or the like, into which a preferably cylindrical insertion portion of the flushing water distributor can be fitted in adjoining relationship with the flushing water inlet opening. Usually, that is effected with the incorporation of a seal, preferably in the form of an annular elastic cuff, which then sealingly encloses the insertion portion with an inside surface and which is seated sealingly in the flushing water inlet opening with an outside surface. The flushing water inlet opening for better fixing can additionally include a seat for receiving the flushing water distributor.

A further particular advantage of the solution according to embodiments of the invention is that it can be implemented with regular toilet bowls of normal dimensions, that is to say longer toilet bowls are no longer required, as is the case in particular with the attachment devices. Therefore, the proposed solution provides that there is only one interface between the toilet bowl and the flushing water distributor which preferably comprises plastic, and this considerably reduces the number of fitting operations to be taken into consideration and thus considerably simplifies the process for manufacture of the toilet ceramic pans because, by virtue of the firing process, they can be produced with difficulty in precisely exact and dimensionally true fashion with a plurality of passages or openings.

The arrangement of the functional modules in the technical region means that all functions are at one location and can also be simultaneously fitted. Because the same ceramic pan can be easily converted and/or retro-fitted, the same pan can initially be offered as a regular toilet without a douche toilet function or with a douche toilet function. At any event, in the case of a defect in the functional modules, in particular the douche toilet technical assembly, the toilet can always be used as a regular toilet. As no attachment fitted on the pan is required there are no additional edges and/or joints in the upper user region of the toilet. The toilet seat including the toilet lid and the seat ring can thus be made from any suitable material, including standard materials, in particular plastics, as for example a thermoset; accordingly there is no longer any need to use special materials.

The introduction and distribution of the flushing water only by way of the flushing water distributor can provide for toilet flushing without a flushing edge (rimless) which permits substantially easier cleaning of the toilet bowl. The solution according to embodiments of the invention comprising a toilet bowl with a single aperture or only one opening for the water inlet thus resolves all technical demands except for the waste water drainage, in a particularly simple fashion. The solution according to embodiments of the invention is therefore closed off in a highly delicate and upwardly flat configuration.

Preferably, the flushing water distributor includes a flushing water feed in the form of a connecting portion and a flushing or deflector plate, which functions as the actual flushing water distributor and the personal cleaning device for personal genital and/or anal cleaning, which particularly preferably includes a flushing lance (also: douche toilet lance), which can be extended upon actuation. The personal cleaning device preferably includes a separate water supply, that is to say also a separate flushing water conduit, which can be fed from the flushing water tank or separately supplied.

In addition, there is preferably provided a separate electrical supply conduit.

In an embodiment the deflector plate is arranged flange-like at the end of the connecting portion, that is the front end in the installed position, and is of a wider outside diameter than the connecting portion so that the deflector plate functions as an abutment upon insertion of the connecting portion into the through opening or flushing water inlet opening of the toilet bowl. Preferably, the deflector plate and connecting portion are of a one-piece construction, particularly preferably in the form of an injection molding produced in one piece. At any event, the connecting portion functions as a flushing pipe connector which is connected at its rear end to the flushing water feed.

In another embodiment the flushing water distributor is substantially in the form of a hollow cylinder which at the front end includes at least one flushing water opening for discharge of the flushing water. That flushing water opening is preferably adapted to the respective toilet bowl to provide for as complete flushing as possible of the toilet bowl. That can be effected for example by the flushing water openings being arranged in a semicircular configuration at the lower end of the flushing water distributor, that is at the front in the installed position. An alternative design provides for it to be in the form of a continuous slot.

In a development there can be provided a displaceable closure member with which water passing through the flushing water opening or openings can be adjusted as required.

Separately from the personal cleaning device for the water discharge for anal or vaginal cleaning, the flushing water distributor can also include a further air opening for the discharge of air, from which drying air can issue, which drying air can in addition also be warmed. That air opening can be integrated in the flushing water distributor by a flap which is pushed open by the flushing lance upon being extended and from which air then issues. That can even be effected at the same time as the intake flow of the flushing water. The air opening however can also be provided in the toilet seat, particularly preferably in the seat ring. Such a separation means that the primary douche toilet function can be implemented in a slender and inexpensive fashion. Only if a dryer function and/or a seat heating function is required that can be subsequently additionally purchased and fitted. In both embodiments, by virtue of a reversal in the direction of the air flow, that air opening can also function as an odor suction removal means.

In the particularly preferred embodiment the flushing water distributor comprising flushing water feed connection, receiving element for the toilet lance, the front deflector or flushing plate can be in the form of an integral unit which preferably involves the geometry of an elongate round connection with an enlargement portion at the front side, which by virtue of the round configuration can be particularly well fitted into the flushing water feed opening, that functions as a receiving opening, in the toilet bowl. That integral assembly is referred to hereinafter as the "toilet lance."

The flushing water distributor can further include a preferably releasably fixable distributor, which distributes the flushing water issuing from the deflector plate in the flushing operation, as required in the flushing chamber in response to the geometry thereof, that is adapted to the situation of use and the toilet bowl. In that respect, it is always necessary to ensure that a primary flow is deflected directly downwardly into the discharge or siphon, in order to pass over the edge of the odor trap, and a secondary flow is passed laterally for flushing out feces clinging to the walls of the toilet bowl. The solution according to embodiments of the invention provides that the entire technical assembly is thus received and concealed in the wall behind the toilet bowl. Only the absolutely necessary elements for also making the douche toilet functions usable are disposed in front of the wall. These are, for example, a remote control, the toilet lance and an optional fan and/or an odor suction removal means.

In the simplest embodiment the personal cleaning device is in the form of a simple opening in the form of a nozzle, through which cleaning water issues for intimate cleaning of the user. That nozzle is then preferably moveable in order to adjust the jet angle to a position suitable for the user.

In the case of an extendable flushing lance, it can be driven either by way of an electric motor or hydraulically, for which purpose the respective supply lines are then to be provided individually or in combination.

To simplify cleaning and/or maintenance the front nozzle unit of the flushing lance or toilet lance is preferably removable.

An advantage of an embodiment of the invention is that the douche lance can also be used in the retracted rest position for cleaning the douche lance, that is to say for flushing through the components and for removing lime and feces therefrom.

To avoid contact with the user it is advantageous if the flushing lance is introduced into the internal space in the toilet bowl at an angle of about 45°. For that purpose, the flushing water distributor preferably includes a receiver having an inclined portion, into which the flushing lance or its housing can be fitted in order to achieve the desired actuating angle. The angle of the inclined portion of the flushing water distributor can also be adjustable, for example by a knurled screw.

The functional modules of the douche toilet are particularly readily accessible if provided in the wall behind the toilet bowl is a large inspection opening, which extends at least over the region from the upper edge of the fitted toilet bowl approximately half a meter upwardly to the region where usually the actuating buttons for the toilet are arranged, and that inspection opening is covered by a removable front panel, as described in European patent application publication EP 2 281 957 A1 to the present applicant. That configuration in that respect affords an optimum platform for douche toilet functions. In the concept described in EP 2 281 957 A1 the actual douche toilet functional modules however are always separate from the toilet bowl.

The parts of the flushing water distributor are preferably made from plastic, particularly preferably in the form of a plastic injection molding comprising a thermoplastic material, preferably polystyrene, but they can also comprise other suitable materials. The cover plate and parts which are in contact with feces are preferably made entirely or partially from glass.

The preferred embodiment includes a sensor for presence detection, which ensures that the douche toilet function is triggered only when a user is using the toilet. That sensor is preferably arranged in the flushing water distributor, but it can also be arranged on the toilet seat or in the toilet bowl.

The man skilled in the art will understand that the material from which the toilet bowl is made is not an important consideration for the invention, although it will usually comprise ceramic material, that is to say it is in the form of toilet ceramic.

At the present time there are two basic forms of toilet bowl on the market, that is to say pedestal toilets, that is to say toilets with a base standing on the floor, and wall toilets which are fixed to a wall behind the toilet bowl. In principle, the invention can be used for all kinds of toilets, but it is necessary according to embodiments of the invention that the toilet bowl provide a through opening which is continuous and which extends linearly from the inner flushing chamber to the rear wall connecting surface and into which the flushing water distributor according to the invention can be inserted from the front. Toilet bowls existing on the market do not have such a through opening, because a separating wall or water distribution wall or a rim is always provided in the region of the flushing water inlet into the flushing chamber. Adjoining those walls at the rear side of the toilet bowl is a passage into which a connecting pipe with lip seal is fitted for connection to a flushing pipe connector, after it has been previously cut to the correct length for the specific situation of use involved. As according to embodiments of the invention a separate passage is no longer necessary for a connecting pipe, the volume required by the toilet bowl is reduced. As the water paths or the water-deflecting components are now provided in or on the flushing water distributor, the toilet bowl can consequently be of a substantially more delicate configuration. In addition, the time-consuming process of cutting to length is eliminated, which markedly reduces the fitment time. Finally, the appropriate configuration of the flushing water distributor means that a flushing pipe connector for connection to the flushing water conduit of the flushing cistern is no longer absolutely necessary, so that it is also possible to dispense with that flushing pipe connector. The space which is liberated by elimination of the ceramic flushing water conduit and distribution means is thus available for receiving the douche toilet lance. Therefore, the rear part of the toilet bowl no longer has to be higher than the seat region. In that respect, the design of the toilet bowl is completely independent from the douche toilet technology, by virtue of the invention.

In that respect, an embodiment of the invention also concerns a novel toilet bowl with a through opening extending from the inner flushing chamber to the rear side for receiving the flushing water distributor, which is preferably of a linear configuration.

Preferably, that through opening is arranged directly above the waste water drain.

The douche lance (flushing lance) is preferably hydraulically driven, wherein the inflowing water urges the douche lance, which is longitudinally displaceably received in a lance housing, into the cleaning position against a compression spring, and the compression spring moves the douche lance into the retracted rest position again after the water pressure decreases.

To permit simple mounting and dismantling of the douche lance in the toilet the combination component is preferably adapted to fit same from the inside of the toilet without removal thereof from the wall. Preferably, that is effected by a union nut which can be releasably fixed by way of a fixing means to the front end of a lance housing, closes the lance housing at the front end in the installed position and includes a through opening for the douche lance. Preferably, the fixing means are in the form of a screw connection.

In an embodiment which is particularly preferred from the production engineering point of view, the lance housing is integral in the sense of being made in one piece with the flushing water distributor. The lance housing can be, for example, in the form of an internal cylinder within the flushing water distributor, the cylinder longitudinal axis of which preferably includes with the longitudinal axis of the flushing water distributor an acute angle which is preferably between 5 and 25 degrees, particularly preferably being 15 degrees.

It is, however, also possible to provide means for adjusting the angle, for example a knurled nut between the internal cylinder and the flushing water distributor, which can preferably be fixed in the target position.

The flushing distributor can include a separator for dividing up the flushing water flow. Preferably, the separator includes inside separating walls which extend in the longitudinal direction and which divide or deflect the flushing water flow, in a manner adapted to the structure of the toilet bowl.

The preferred embodiment provides a central passage for supply for the front flushing water opening as well as two side passages extending laterally thereof.

In addition, the flushing water distributor can include water deflection devices for appropriately deflecting the water, preferably at the water discharge at the front end. The deflection devices can be associated with the individual passages in order to deflect the water flowing out of the passages as required to the target position in the toilet bowl. Preferably, the water deflection devices are in the form of inclined portions or bucket-like curvatures in order to deflect the water flowing through the flushing water distributor at the front end to the side, for example into lateral passages at the upper end of the toilet bowl for providing for flushing of the ceramic pan or the toilet bowl over as full a surface area as possible, including to the front end.

In a preferred embodiment about 70% of the flushing water flow is deflected laterally distributed to both sides, and the remaining water flow is deflected through the central passage downwardly into the flushing water distributor.

The water deflection devices can also be adapted to be adjustable for easy adaptation of a standardized flushing water distributor to the individual circumstances.

The water deflection devices are preferably adapted to prevent flushing and/or cleaning water from unwantedly spraying upwardly out of the toilet opening and in that respect are usually designed to be laterally delimiting and deflecting downwardly into the flushing chamber.

In an advantageous development provided at the toilet bowl or the toilet ceramic pan are water guide passages or water deflection passages, for example lateral water guide passages at the rim of the toilet bowl or a ring-like projection at the rear end of the toilet bowl with water openings spaced in a ring-like configuration for rinsing the rear region, fed from the central passage of the flushing water distributor. In the preferred embodiment the flushing water distributor is adapted to feed the flushing water at least partially to water guide passages, for example by the above-mentioned water deflection devices. Water distribution or water guidance is in that respect effected entirely or partially in the toilet bowl.

Preferably provided on the flushing water distributor are connecting elements which in the installed position connect or adapt to passages provided in the toilet bowl in as transition-free manner as possible. Those passages are preferably in the joint line and are preferably formed from the two molded halves of a ceramic pan. Preferably, those passages extend very smoothly into the bowl or the flushing chamber. The passages are preferably of such a configuration that the flushing water flushes out the complete bowl or the complete flushing chamber without great losses of kinetic energy.

In that respect the invention involves two basic solutions:

In the first, the flushing water distributor can be fitted into the flushing water opening from the front, that is to say from the internal space in or the flushing chamber of the toilet bowl, in such a way that the toilet bowl has to be removed from the wall. The second solution involves a flushing water distributor which can be connected to the toilet bowl from the rear side before fixing of the toilet bowl to the wall. In both solutions the lance housing of the flushing lance can either be fitted separately in a receiver in the flushing water connection or it is integral, that is to say in one piece, with the flushing water connection, the latter representing the preferred embodiment because it is simpler from the point of view of production and mounting.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF EMBODIMENTS OF THE INVENTION

Figure 1:
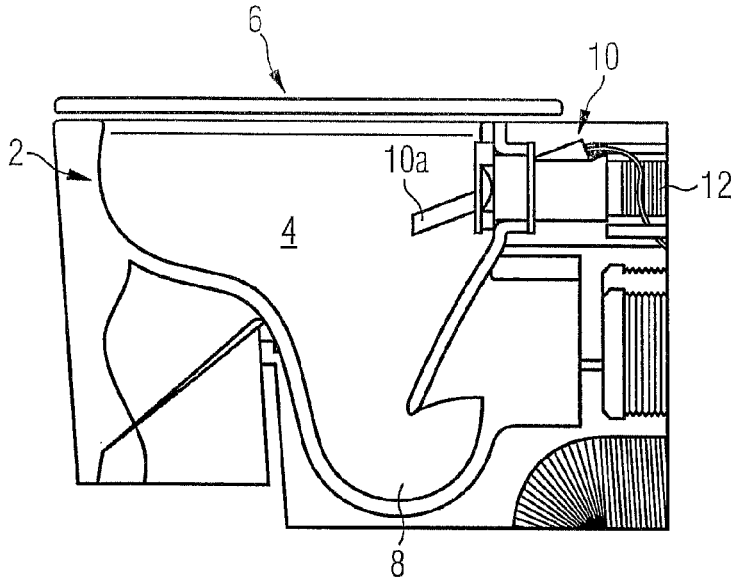
FIG. 1 shows a sectional side view of a toilet ceramic pan with a flushing water distributor according to an embodiment of the invention.

FIG. 1 thus shows a cross-section through a conventional toilet bowl which is in the form of a toilet ceramic pan which includes a flushing chamber 4 and on the top side of which a toilet seat 6 is mounted.

At its lower end the toilet bowl 2 has a siphon 8 which is usually filled with water. Adjoining that siphon 8 at the rear side of the toilet bowl 2 is a waste water connection, by way of which waste water drainage of the waste water can be performed in a flushing operation.

At its end at the rear in the installed position the toilet bowl 2 has a flushing water inlet opening 2*a* (see also FIG. 5); it is not simply the flushing water feed pipe that is connected to the flushing water inlet opening 2*a*, but the flushing water distributor 10 according to the invention is also fitted there. FIG. 1 shows that flushing water distributor 10 in the installed position with extended douche lance (flushing lance) 10*a*.

Figure 2:
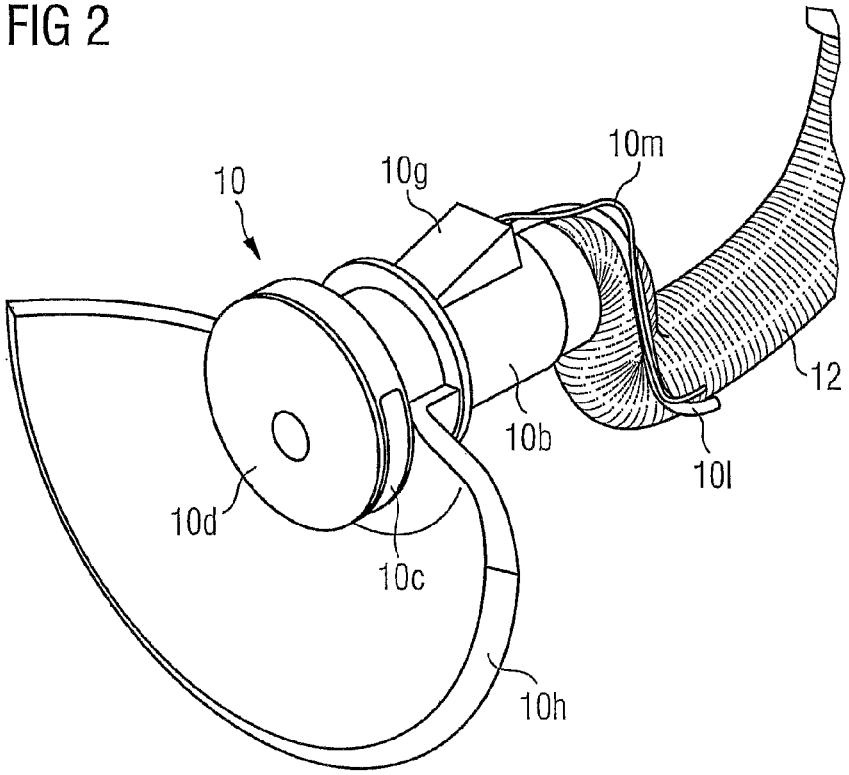
FIG. 2 shows an enlarged perspective view of the flushing water distributor.

FIG. 2 shows an enlarged perspective view of the flushing water distributor 10 without the surrounding toilet bowl 2. Accordingly, the flushing water distributor 10 includes a substantially tubular connecting portion 10*b* which can be connected to a flushing pipe connector 12 at its end which is at the rear in the installed position. In the state of the art it was hitherto necessary for that flushing pipe connector 12 to be cut to length with a rubber seal at the front end for insertion into a receiver in the pan. That is now no longer necessary with the invention. More specifically at its rear end the flushing water distributor 12 is provided with a fixing element, preferably a clamping and rubber seal, in order to connect same particularly preferably without a tool to the flushing pipe connector 12 after insertion into the toilet bowl 2. At any event the invention eliminates the time-intensive operation of cutting the flushing tube connector to length, as was required in the state of the art, and that markedly reduces the fitment time.

Figure 3:
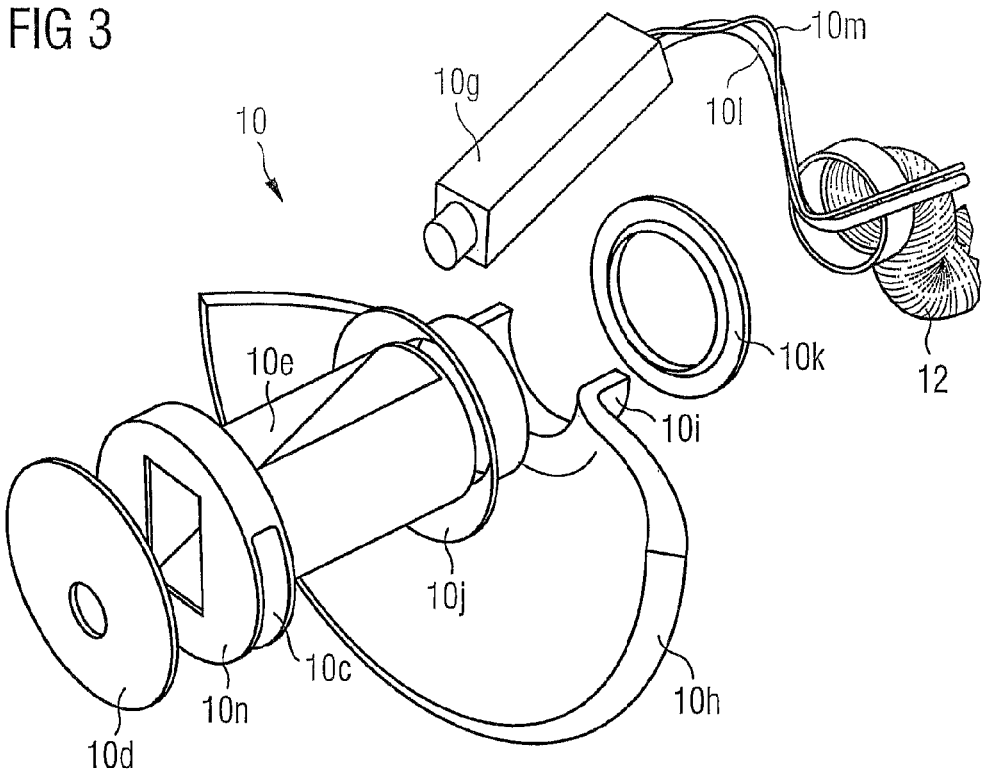
FIG. 3 shows a perspective exploded view of the flushing water distributor of FIG. 2.

The precise structure of the flushing water distributor 10 can be even more clearly seen from the exploded view in FIG. 3. Accordingly, the connecting portion 10*b* at its front end has a deflector plate 10*n* which is markedly widened in relation to the nominal diameter of the connecting portion 10*b* and has lateral water outlet openings 10*c* through which the flushing water issues. Fitted on the front end of the deflector plate 10*b* is a cover plate 10*d* having a through opening for the cylindrical flushing lance 10*a*. In the retracted position the front end of the flushing lance 10*a* terminates flush with the front face of the cover plate 10*d*. In the extended position flushing water sprays out of nozzles at the front end of the flushing lance 10*a* for performing personal genital or anal douching of the user.

To receive the housing 10*g* of the flushing lance, provided at the top side in the connecting portion 10*b* is a receiver 10*e* having a ramp-like inclined portion which is geometrically adapted for receiving the housing 10*g* of the flushing lance 10*a*. Thus the housing 10*g* of the flushing lance 10*a* can be inserted into that receiver. The flushing lance 10*a* is relatively moveably received in the housing 10*g* and can be extended into the flushing position by water pressure or an electric motor.

The flushing water distributor 10 may also have a shell-shaped additional distributor 10*h* in the shape of a surface in the form of a quarter of a sphere, with a fixing connection 10*i* at its rear end, the diameter of which is adapted for insertion into the flushing water inlet opening 2*a* in the toilet bowl 2.

Thus, in the flushing operation the flushing water flows out of a flushing water container arranged in a wall behind the douche toilet through the flushing pipe connector into the connecting portion 10*b* of the flushing water distributor 10 and laterally flowing past the inclined portion 10*e* impinges on the front deflector plate 10*n*, from which it then issues laterally from the water outlet openings 10*c* in order then to flow from the additional distributor 10*h* in accordance with the geometry thereof into the flushing chamber 4 for performing the flushing operation. It must be emphasized however that the desired flushing function, that is to say deflection of the flushing water, that is adapted to the requirements involved, can also be achieved without that optional additional distributor 10*h*.

In the assembly operation, first, the additional distributor 10*h* is fitted with the fixing connection 10*i* into the flushing water inlet opening 2*a* in the toilet bowl 2. Then, an elastic sealing cuff 10*j* having a peripherally extending flange is pushed on to the connecting portion 10*b* to surround same, and is sealingly pushed into the flushing water inlet opening 2*a* with clamping of the fixing connection 10*i*. The connecting portion 10*b* is then screwed from behind with the incorporation of a rear sealing ring 10*k* with a union nut (not shown). After insertion and connection of the housing 10*g* of the flushing lance 10*a* in the inclined receiver 10*e*, the rear end of the connecting portion 10*b* is connected to the flushing pipe connector 12 Finally, the separate water and power lines 10*l*, 10*m* for supplying the flushing lance 10*a* are also connected.

Figure 4:
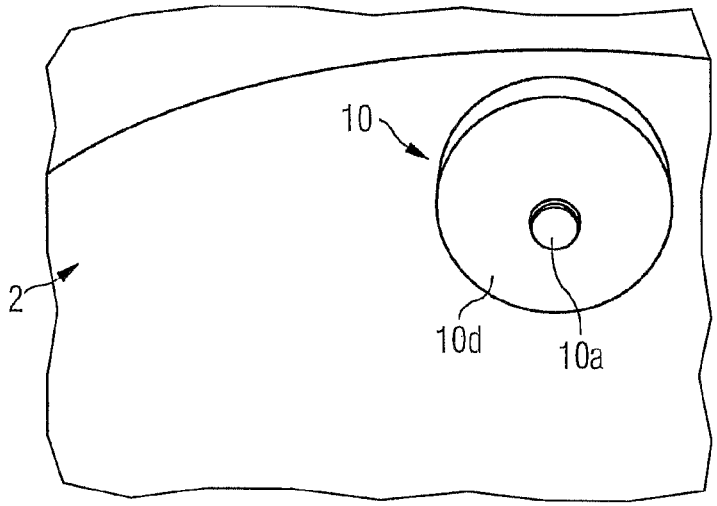
FIG. 4 shows a front view of the flushing water distributor in the installed position in the toilet pan.

FIG. 4 shows an enlarged view of the flushing water distributor 10 in the installed position with the toilet seat 6 open. By virtue of different additional distributors 10*h* it is possible for the flow characteristic of the flushing water distributor 10 to be adapted as required to the geometry of the respective toilet bowl 2 to achieve optimum flow and flushing properties for the body.

Figure 5:
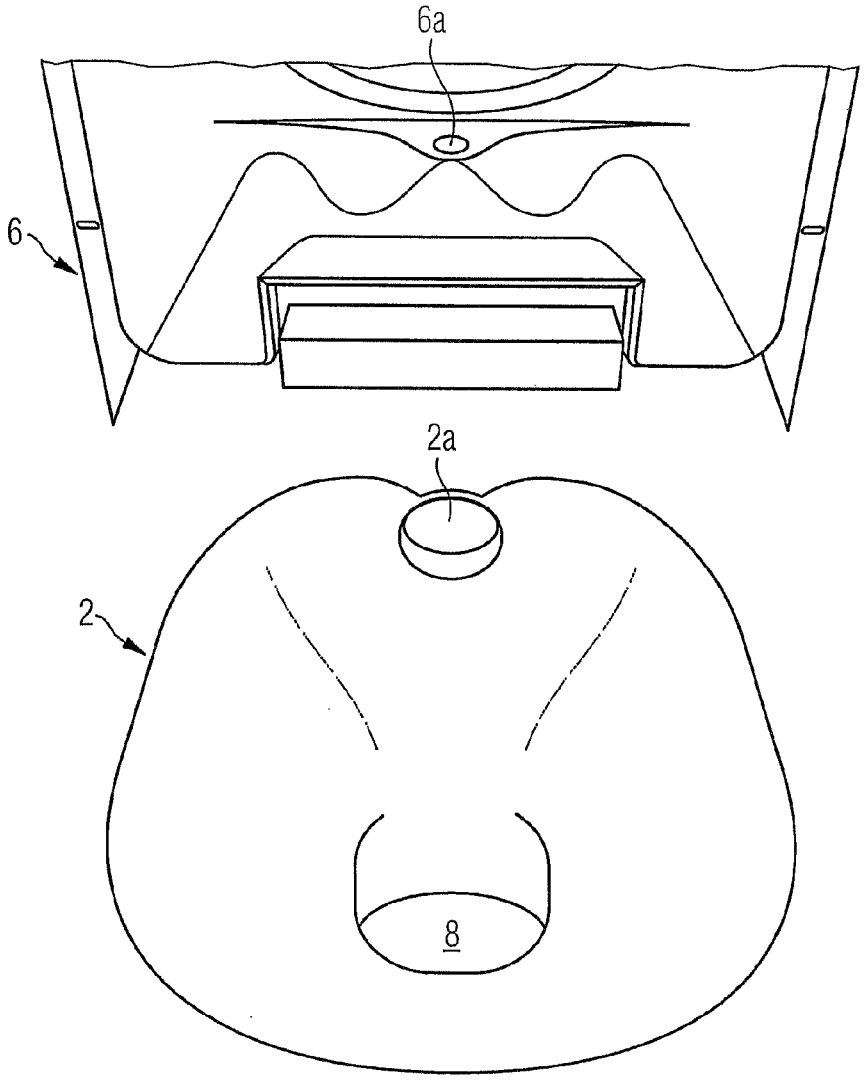
FIG. 5 shows a front view of a toilet pan with flushing water distributor removed and a dryer function integrated in the toilet seat.

FIG. 5 shows an enlarged front view of the toilet bowl 2 with the lifted toilet seat 6 and with the flushing water distributor 10 (toilet lance) removed so that the flushing water inlet opening 2*a* is visible. Formed integrally at the underside of the toilet seat 6 is an air opening 6*a* through which air can flow to produce a dryer function and/or for odor suction removal within the flushing chamber 4 and thus at the bottom of the user. Air can flow through for odor suction removal or by reversal of the flow direction for warming the toilet. The feed conduits for the air supply for the dryer is effected for example by way of the fixing of the toilet seat in the region behind the toilet pan. From here the connection is made to the technical box which contains the fan and the heating coil. Alternatively, the fan and the heating means can also be integrated directly in the seat. Then only the power supply is effected by way of the seat fixing to the technical box in the wall.

Figure 6:
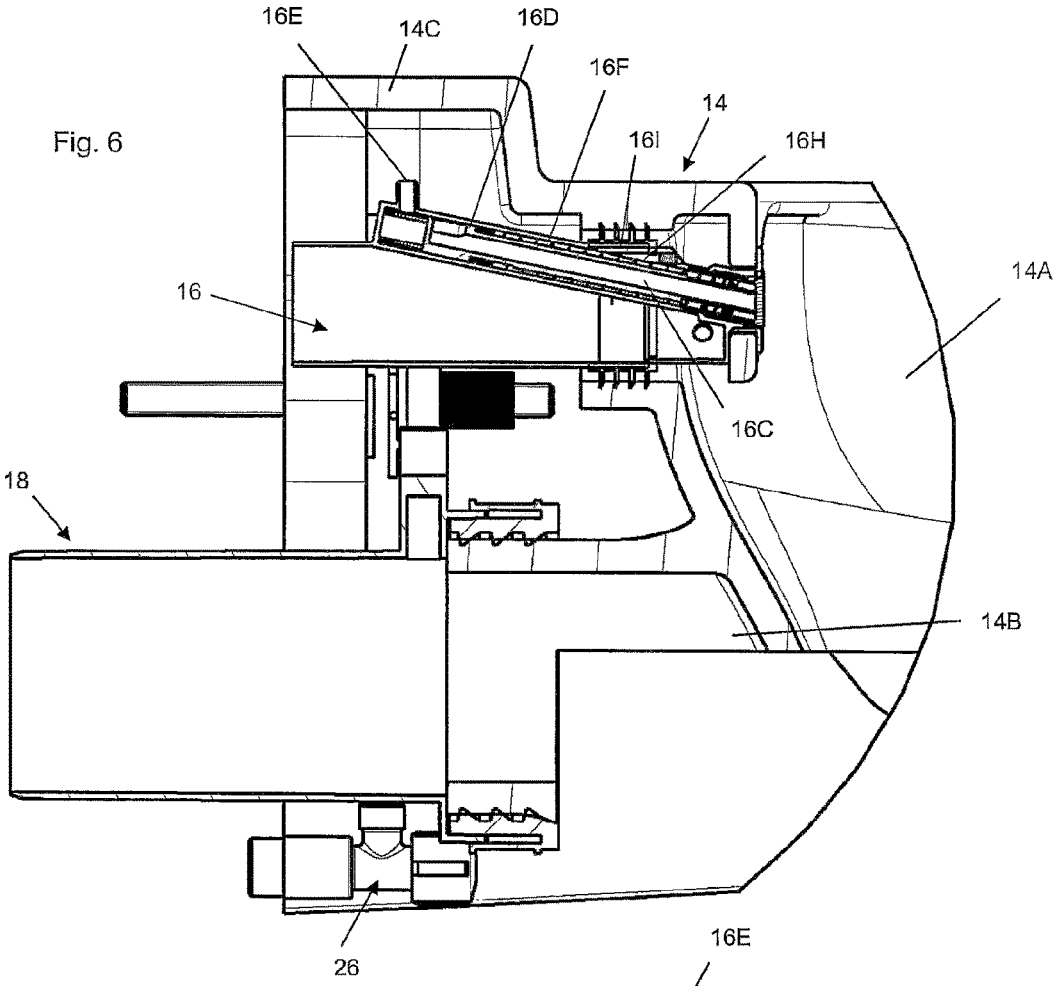
FIG. 6 shows a longitudinal section through the rear end of a douche toilet with a second embodiment of the flushing water distributor according to the invention.
Figure 7:
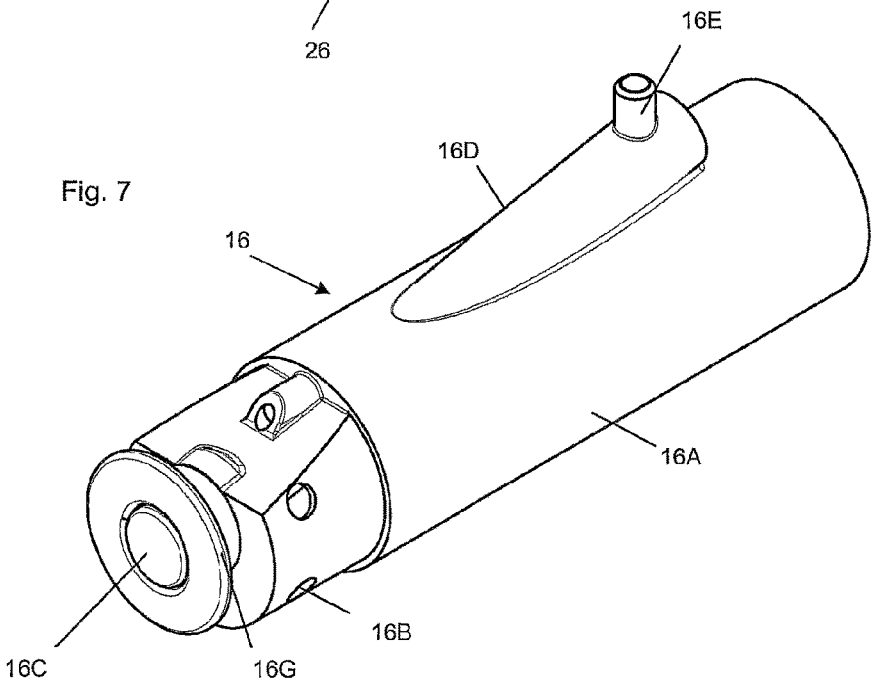
FIG. 7 shows a perspective view of the lance unit integrated into the flushing water connection.

FIGS. 6 and 7 show an alternative embodiment of a douche toilet with a toilet ceramic pan 14, into which a flushing water distributor 16 is inserted at the rear at the upper end with a drain connection 18 being inserted at the lower end.

The invention, however, also concerns a novel toilet bowl, preferably made from ceramic, adapted for installing or for receiving the flushing water distributor 16 according to the invention. According to embodiments of the invention, the toilet bowl 2 includes a seat 22A for receiving the flushing water distributor at the rear side in the installed position and for connection to the toilet bowl 2.

The flushing water distributor 16 and the drain connection 18 are respectively fixed at the rear to the toilet pan 14 only by a seal which is preferably in the form of a sealing cuff; therefore there is in each case only one sealing location which has to be fitted and checked. That represents a considerable advance over the state of the art in which the connections always include a plurality of passages on the toilet bowl, which each have to be sealed off and in that respect can also leak.

In a flushing operation the flushing water distributor 16 feeds flushing water from a flushing cistern arranged behind the wall and connected to the flushing water distributor 16 by way of a flushing pipe (not shown) and which is preferably installed in the wall in the form of a concealed cistern. The flushing water is distributed by way of the flushing water distributor 16 into the flushing chamber 14A defined by that toilet pan, as far as the front end thereof, and issues therefrom by way of the toilet or primary siphon 14B in the lower end of the toilet pan 16, through the waste water connection in the form of a drain connecting portion 18, into a drain pipe. The primary siphon 16B thus prevents the discharge of odors from the waste water conduit into the toilet pan 14 or the toilet bowl or the douche toilet in known manner by the water contained in the lower curvature after the flushing operation.

The flushing water distributor 16 comprises a substantially hollow-cylindrical flushing water connection 16A having a front end which can be sealingly fitted into the rear side of the toilet pan 14 and a rear end which can be connected to a flushing pipe. The flushing water flows out of the flushing water container through the flushing water connection 16A in a flushing operation through a plurality of flushing openings 16B which are directed at the front end in the installed position downwardly and to the side, into the flushing chamber 14A of the toilet pan 14. The inflowing flushing water is thus distributed in a ring-like or fan-shaped configuration through the flushing openings 16B to provide for flushing over as full a surface area as possible, starting from the rear side, along the side surfaces as far as the front end of the flushing chamber 14A of the toilet pan 14. The flushing characteristic can be adapted according to requirements to the configuration of the toilet bowl by altering the arrangement of the flushing openings 16B.

Instead of the flushing openings 16B which are spaced peripherally from each other on the peripheral surface an alternative embodiment provides a continuous flushing slot which is preferably provided at the lower half of the front end of the flushing water distributor 16.

In a preferred development the flushing water distributor 16 can include an adjusting device for opening and closing the flushing openings 16B or the flushing slot, as required, for example, in the form of a moveable slider.

In the embodiment shown in FIGS. 6 and 7 the douche lance 16C (lance slider) is integrated in the flushing water connection or the flushing water distributor 18, and is therefore in one piece therewith. For that purpose, a cylindrical lance housing 16D for longitudinally displaceably receiving the douche lance 16C is formed extending transversely relative to the longitudinal axis of the flushing water distributor 16 integrally at the top side of the flushing water distributor 16 in the form of a one-piece injection molding, wherein the diameter of the lance housing 16D is markedly less than the diameter of the flushing water distributor 16 and is preferably approximately a third of the diameter of the flushing water distributor 16. The longitudinal axis of the lance housing 16D or the douche lance 16C includes an angle of between 3 and 35 degrees, preferably 15 degrees, with the longitudinal axis of the flushing water distributor 16.

In a development, adjusting means are provided for adjusting the angle of inclination of the lance housing 16D or the douche lance 16C in relation to the longitudinal axis of the flushing water distributor 16 or the flushing water connection, for example including a knurled screw. The inclination of the douche lance 16C can be adapted to the respective structural circumstances of the toilet bowl by adjustment of the angle of inclination when the toilet bowl therefore involves different geometrical configurations or when the douche lance 16C is to be caused to extend to differing depths into the flushing chamber 14A.

At its rear end in the installed position the lance housing 16D has a connecting nipple 16E for a separate fresh or drinking water conduit.

In a development the end position of the lance can also be adjustable in order thereby to alter the position of the jet by varying the depth of penetration of the lance into the bowl in the extended position. In a preferred solution that is effected by an adjustable abutment using a Bowden cable which is fixed to an operating element and is adjustable by way thereof.

When cleaning water for personal cleaning flows into the lance housing 16D by way of the connecting nipple 16E, for example in controlled fashion by way of a cartridge, the water pressure initially drives only forwardly the douche lance 16C arranged longitudinally displaceably in the lance housing 16D, by virtue of an annular flange shaped or provided integrally at the inside wall, against a compression spring 16F acting between the douche lance 16C and the front side of the lance housing 16D, so that the douche lance 16C issues into the flushing chamber 14A of the toilet through an opening in a union nut 16G. However, as soon as the water can flow past the annular flange at that annular seal when the douche lance 16C is sufficiently advanced, in the passing chamber 16H, which is the case for example when the douche lance 16C is half extended, the flushing water issues from outlet openings at the front side in the douche lance 16C for performing the personal cleaning operation. The douche lance 16C is therefore adapted for the personal cleaning operation to occur when it is only half extended.

Provided at the upper rear end of the toilet bowl or the toilet pan 16 is an upwardly projecting step 14C into which the rear end of the lance housing 16D and the connecting portion 16D projects to permit simple fitment of those components. The height of the step 14C is no higher than the height of the fitted toilet lid in the closed condition and in that respect fits harmonically into the overall image of the toilet. The step 14C is also simple to clean as it is integrated throughout in one piece into the ceramic.

By virtue of the small structural volume necessary, it is also possible for the invention to be implemented without such a step 14C in the toilet bowl 2.

For mounting, dismantling and/or maintenance of the douche lance 16C it is only necessary to remove the union nut 16G, the compression spring 16F and the douche lance 16C (lance slider). Thus, the douche lance 16C can be installed and maintained even with the toilet completely mounted, without removing it from the wall, which represents a marked improvement over the state of the art.

Figure 8:
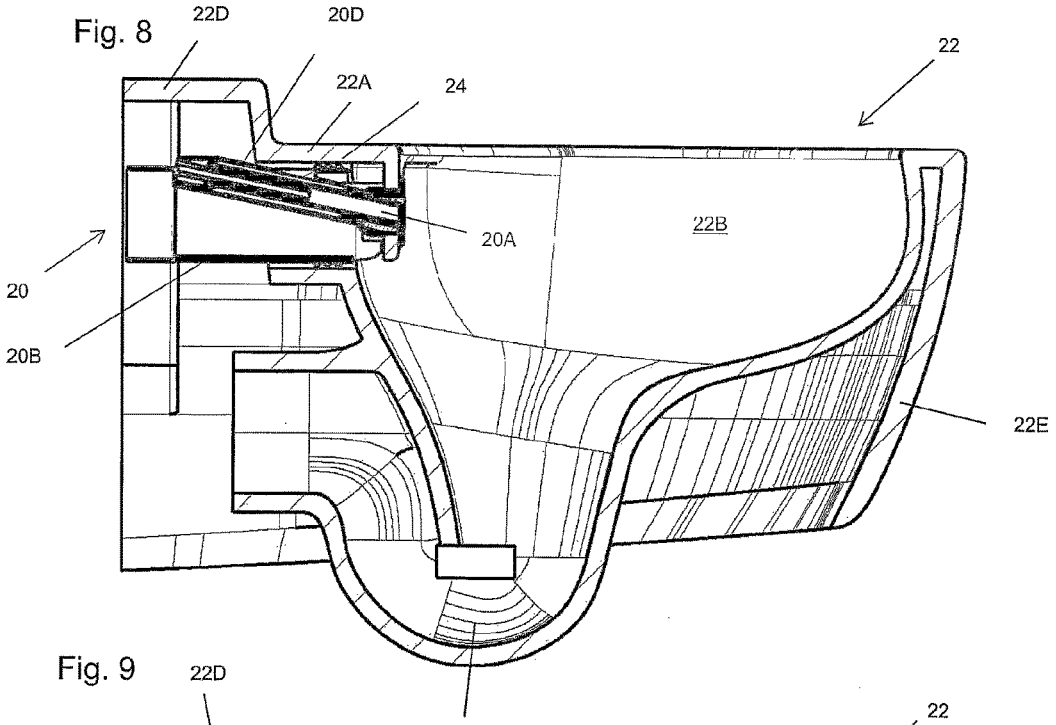
FIG. 8 shows a longitudinal section of the one douche toilet with a third embodiment of the flushing water distributor according to the invention with the douche lance retracted.
Figure 9:
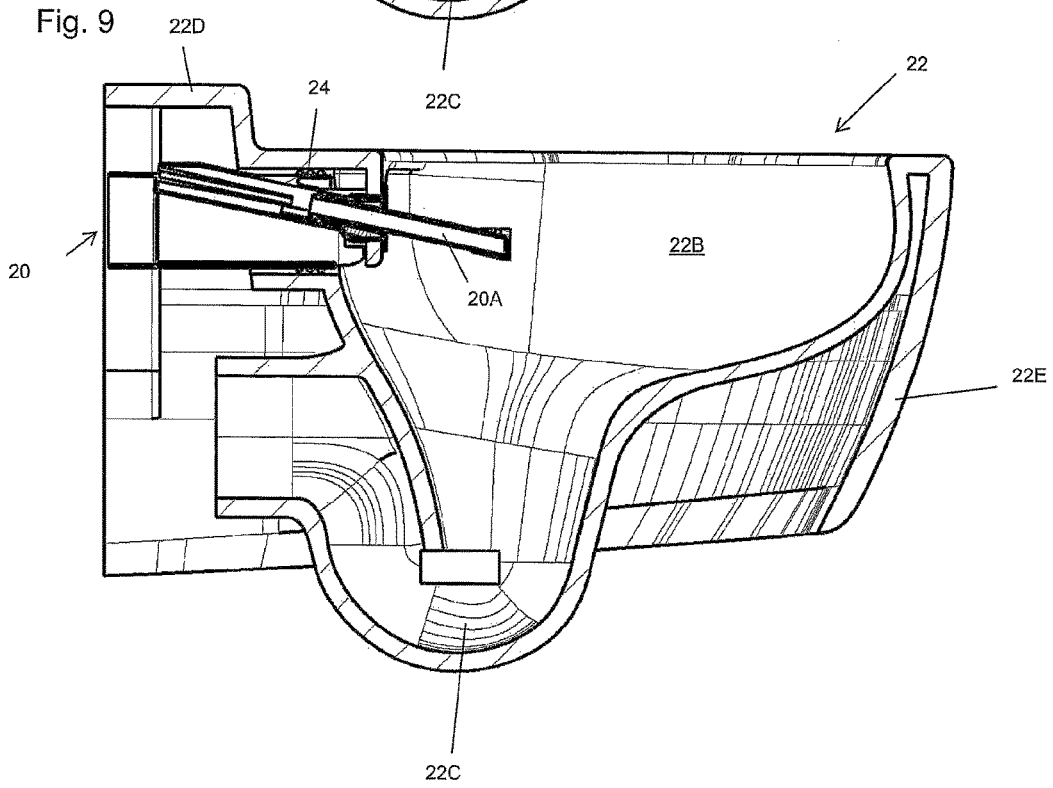
FIG. 9 shows the douche toilet of FIG. 8 in longitudinal section with the douche lance extended.
Figure 10:
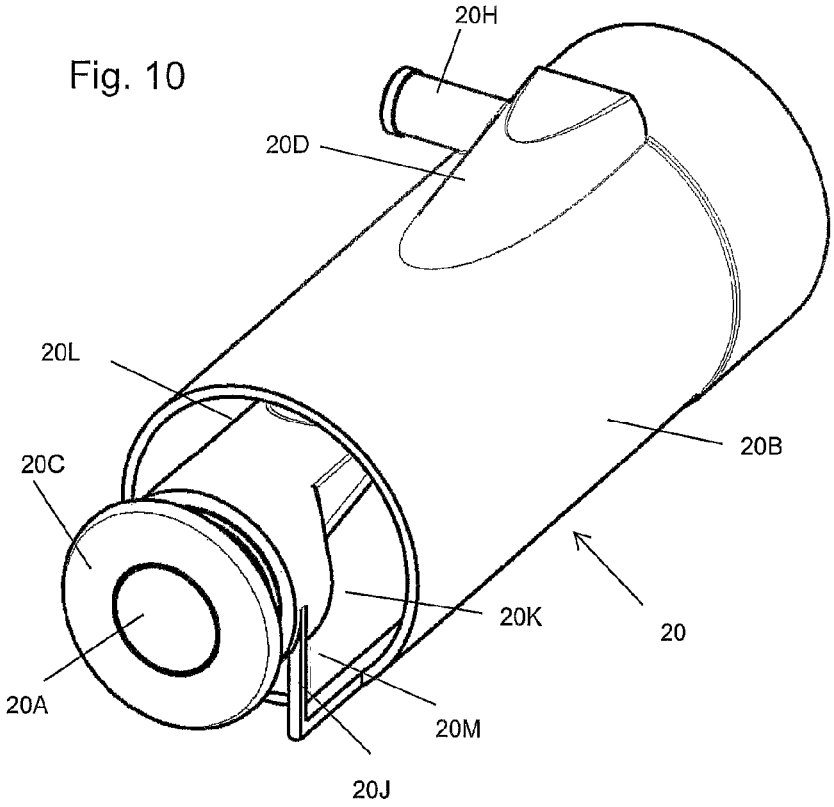
FIG. 10 shows an enlarged perspective view of the flushing water distributor of the third embodiment of FIGS. 8 and 9.
Figure 11:
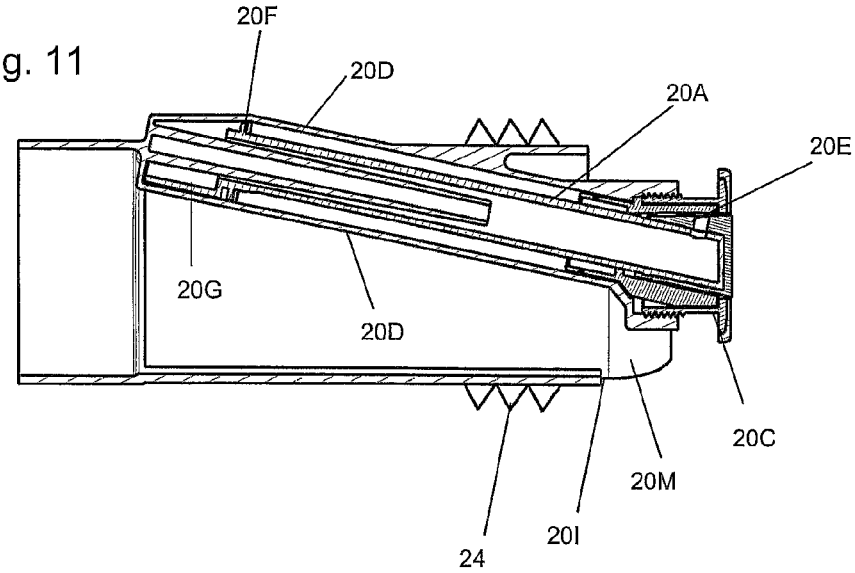
FIG. 11 shows a longitudinal section of the flushing water distributor of FIG. 10 with the douche lance in the retracted rest position.
Figure 12:
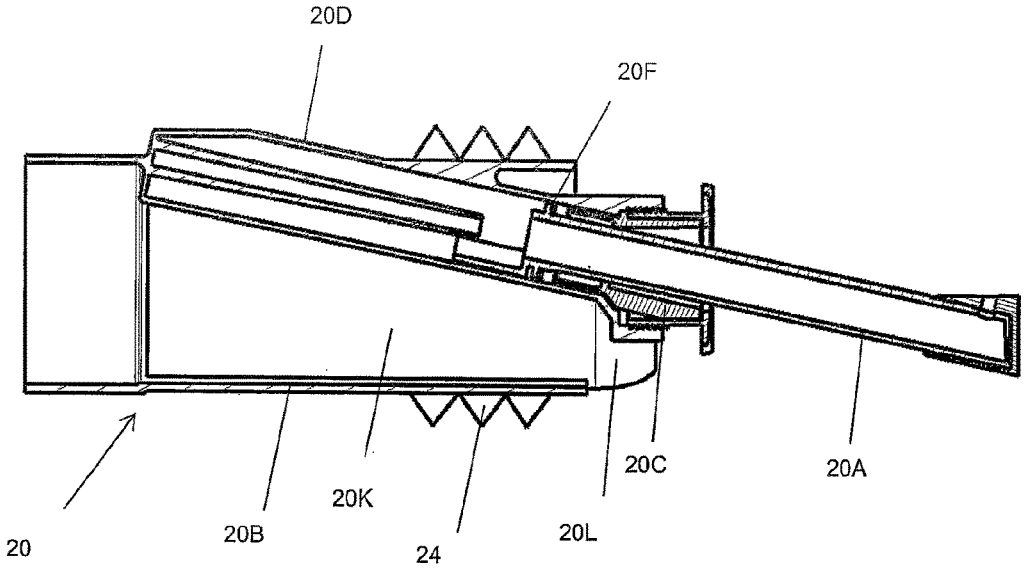
FIG. 12 shows the flushing water distributor of FIG. 11 with the douche lance in the extended cleaning position.

FIGS. 8 and 9 show longitudinal sections through a douche toilet for cantilever mounting to the wall or dry wall with a third embodiment of a flushing water distributor 20 received in a seat 22A of a toilet pan 22.

In this embodiment also the flushing water distributor 20 which is substantially formed from a hollow-cylindrical flushing water connection 20B is fitted by a single sealing cuff 24 into the cylindrical seat 22A of the toilet pan 22 which here forms the water inlet opening of the toilet pan 22.

FIG. 8 shows the douche lance 20A in the retracted rest position, whereas FIG. 9 shows the douche lance 20A in the extended cleaning position in which it assumes the optimum position in the flushing chamber 22B, the lower end of which communicates with a siphon 22C which with its rear end includes a receiving connection for a waste water connector (not shown).

The third embodiment, shown in FIGS. 8 through 12, of the flushing water distributor 20 with integrated douche lance 20A again comprises a substantially hollow-cylindrical flushing water connection 20B, preferably in the form of an injection molding, having an outer peripheral surface, the outside diameter of which is adapted for fitting in a seat 22A on the toilet pan 22 in front of the flushing water inlet opening thereof. At its rear end the flushing water distributor 20 is adapted for fixing to the flushing water pipe (not shown), for example by sealingly pushing a flushing water pipe on to the rear end, and it is provided at the front end with a distributor device for distributing the flushing water in the flushing operation. In the present case that distributor device includes at the underside a slot-like flushing opening 20I at the front end of the flushing water distributor 20 just below the front end of the flushing water distributor 20, with a screwed-in union nut 20C. In addition the arrangement has water deflection devices which are in the form of side walls 20J for directing the flushing water at both sides beside that flushing opening 20I, the water deflection devices deflecting the flushing water in particular downwardly to avoid it from spraying up.

Provided in one piece in the flushing water distributor 20 is a hollow-cylindrical lance housing 20D for the douche lance 20A, the inside diameter of which is larger than the outside diameter of the received, also hollow-cylindrical douche lance 20A which is closed at its front end and which at the top side includes a cleaning opening 20E. At the rear end the douche lance 20A has a peripherally extending radial flange 20F which, advanced by the water pressure, slides in the longitudinally displaceable extension movement, against the inside of the lance housing 20D. For stabilization purposes the douche lance 20A includes at the rear end a support portion 20G which functions as a stabilizer and an end abutment and which, adapted to the geometry of the lance housing 20D, bears in the installed position against the inside 20D thereof and thus stabilizes the lance 20A against rotation.

FIG. 8 shows the douche lance 20A in the retracted rest position, that is to say prior to the flushing operation, in which the front end also sits in the central through opening within the union nut 20C. FIG. 9 in contrast shows the douche lance 20A in the extended cleaning position.

The longitudinal axis of the lance housing 20D includes an angle of 5-20 degrees, preferably 15 degrees, with the longitudinal axis of the flushing water connection, which axis corresponds to the longitudinal axis of the flushing water distributor 20, but this ultimately depends on the geometry of the toilet pan and the required cleaning characteristics.

The further advantage of the embodiment shown in FIGS. 8 through 12 lies in the possibility of fixing the water connection for supplying the douche lance not from the rear or from the side, whereby the upper step 22D shown in FIGS. 8 and 9 at the rear upper end of the toilet pan 22 can be omitted so that the pan is of an even more delicate configuration.

To reduce the necessary structural height the connecting nipple 20H in this embodiment projects laterally transversely relative to the longitudinal axis of the lance housing 20D.

The toilet pan shown in FIGS. 8 and 9 is in the form of a designer pan with an apron 22E which is formed in one piece thereon and which peripherally encloses the flushing chamber 22B.

Figure 13:
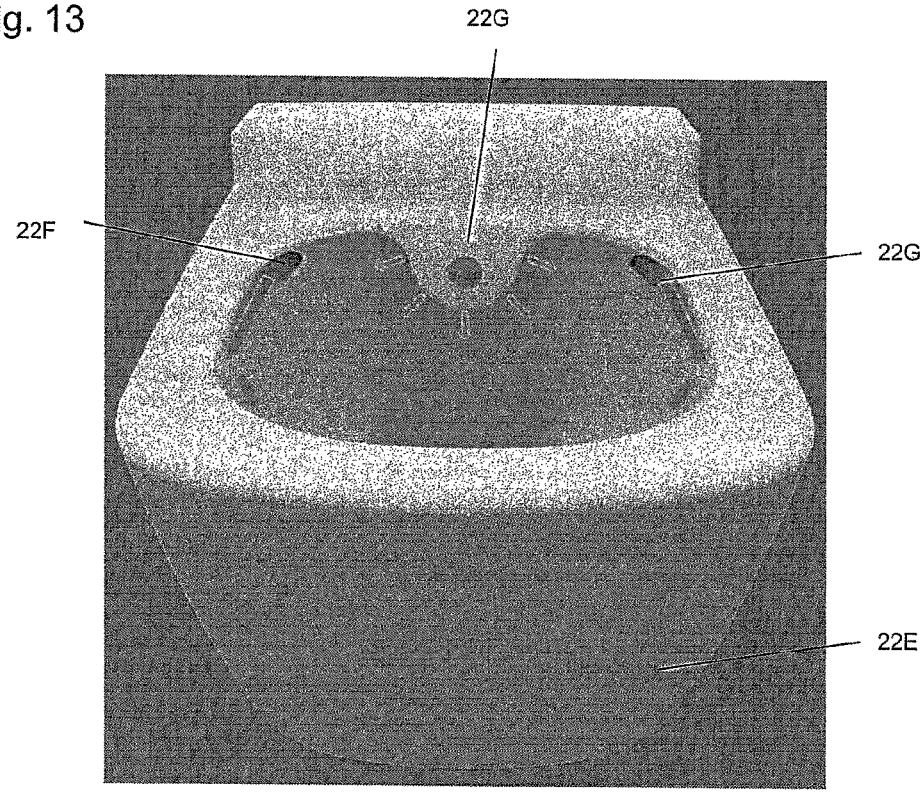
FIG. 13 shows a perspective front view of the design ceramic pan according to the invention with the toilet seat removed.

FIG. 13 shows a perspective front view of the designer pan according to the invention without toilet seat. It is possible to clearly see the apron 22E which extends peripherally around the flushing chamber 22B and which narrows downwardly and which gives the pan a harmonically closed overall impression and is easy to clean. Formed integrally at the upper end of the designer pan immediately below the toilet opening are two lateral and horizontally oriented nozzles 22C, 22D and a ring 22E with a plurality of flushing water through openings provided peripherally at the edge at the rear side for receiving the front end of the flushing water distributor. Those nozzles 22C, 22D provide for a particularly uniform and intensively high level of flushing in the upper region of the pan.

In a development the toilet bowl has a cover for those lateral nozzles 22C, 22D and/or the ring 22E at the rear side, which visually conceals same and acts as a spray protection.

Figure 14:
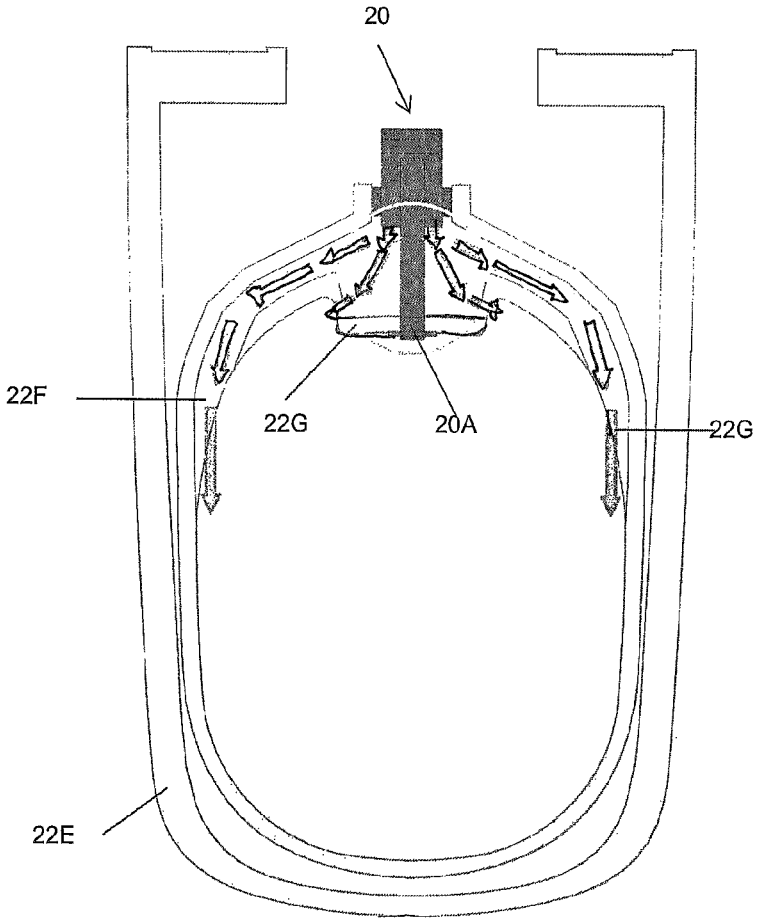
FIG. 14 shows a diagrammatic plan view of the division of the flushing water, caused by the flushing lance.

The division of the flow of water, caused by the flushing water distributor 20, can be particularly clearly seen from FIG. 14 showing a diagrammatic plan view of the flushing water flow during the flushing operation. To divide the flushing water flow the cylindrical flushing water connection 18 in coincident relationship with the sides of the lance housing has two longitudinal walls 20K (only one is visible in FIG. 12) which are spaced from each other in the longitudinal direction in the flushing water distributor 20 in respect of the width of the lance housing so that it includes a central passage and at both sides thereof a respective side passage.

FIG. 13 clearly shows how the water which is divided within the flushing water distributor 20 by the longitudinal walls 20K is deflected for the major part (about 70%), divided up to constitute respective halves, from those side passages into the lateral nozzles 22F, 22G of the toilet pan 22, and thus provides for flushing as far as the front end of the toilet pan 22 and the residual volume flow from the central passage issues directly downwardly through the flushing water openings at the peripheral surface of the ring 22H at the rear end of the toilet pan 22.

The configuration of the flushing water distributor 20 in FIGS. 8 through 14 has a particularly lower pressure drop and besides the lance housing 20D includes an integrally formed internal cylinder 20N which extends within the douche lance 20A and narrows in the direction of the front end from the outside diameter. In the retracted rest position the annular gap between the douche lance 20A and that internal cylinder is very small so that initially no cleaning water at all or only very little cleaning water issues from the cleaning opening 20E. It is only after a certain forward movement of the flushing lance 20A due to the water pressure that that annular gap becomes greater and more cleaning water issues from the cleaning opening 20E. The internal cylinder is preferably so designed that cleaning water noticeably issues from the cleaning opening 20E only when the douche lance 20A is half-extended. The douche lance 20 is therefore firstly extended under a lower pressure and the full flushing pressure then occurs for example after overrunning the internal cylinder.

To deflect the flows of water out of the side chambers of the flushing water distributor the separating walls at the front ends include water deflection devices which are in the form of curvatures 20M directed outwardly in a scoop configuration and which in the installed position fit in transition-less fashion in the inlet openings of the nozzles 22F, 22G.

The drinking water required for operation of the toilet bowl is preferably supplied with faucet or drinking water by way a corner connector 26 concealed by the toilet bowl and accessible from below, as shown by way of example in FIG. 6.

In summary therefore, embodiments of the invention provide a water closet with integrated bidet function, which includes a lance or douche lance which is extendable for the washing operation and which provides water for personal cleaning in specifically targeted fashion for a user, in such a way that cleaning can be effected entirely without using the hands.

The lance housing, for receiving the douche lance longitudinally displaceably accommodated therein, can either be adapted to be inserted into the flushing water distributor or it can be in the form of an integral component in one piece with the flushing water distributor.

By virtue of the arrangement of the douche lance within the flushing water distributor in the manner proposed according to embodiments of the invention, there is therefore no need to provide for the lance housing a separate component disposed beneath or above the flushing pipe. Rather, the douche lance can be positioned in optimized-flow relationship in the upper region of the toilet pan, including in the region of a toilet rim.

According to embodiments of the invention, only one seal is necessary for sealingly fixing the flushing water distributor to the toilet bowl, which seal is preferably in the form of a sealing cuff which either can be fitted as a separate component on to the outer peripheral surface of the flushing water distributor or which can be injection molded thereto in the two-shot process, that is to say it is also an integral component part of the flushing water distributor.

The man skilled in the art will understand that the toilet bowl is only preferably made from ceramic, and it can also be made from other suitable materials, for example plastic.

According to embodiments of the invention, in that respect there is also proposed a novel toilet pan or designer pan which has a seat or a receiver for rear insertion of the proposed flushing water distributor. Initial mounting is effected in that respect from the rear side of the toilet pan on the wall. Maintenance can then still be effected from the front from within the toilet by removal of the union nut. The arrangement according to embodiments of the invention is particularly advantageous in relation to rimless toilets, although it is not limited thereto, that is to say it can also be used in regular toilets with a flushing rim and can even be retro-fitted thereto.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A douche toilet comprising:

a toilet bowl including a flushing water inlet opening to supply flushing water into a flushing chamber defined by the toilet bowl for a flushing operation, the flushing water inlet opening being the only opening for water inlet provided in the toilet bowl, and a waste water opening to flush waste water out of the toilet bowl in the flushing operation, the waste water opening having a primary odor barrier;

a flushing water distributor adapted for fitment into the flushing water inlet opening, between the toilet bowl and a flushing pipe connector, and configured to distribute the flushing water in the flushing chamber, the flushing water distributor comprising a hollow-cylindrical flushing water connection having a front end configured to be sealingly fitted into a rear side of the toilet bowl and a rear end configured to be connected to the flushing pipe connector, wherein the hollow-cylindrical flushing water connection comprises, at its front end, at least one flushing opening for distributing the flushing water; and a personal cleaning device to effect a personal cleaning operation on a user of the douche toilet, the personal cleaning device comprising a douche lance housing integrated into the flushing water distributor and a douche lance longitudinally displaceably received in the douche lance housing and being extendable from a retracted rest position into a cleaning position for the personal cleaning operation, wherein the douche lance is driven into the cleaning position by water pressure, against a compression spring situated in the douche lance housing, through an opening in a union nut inside the flushing chamber, and wherein the douche lance and the compression spring are completely removable forwardly from the douche lance housing after union nut removal.

2. The douche toilet as set forth in claim 1, wherein the flushing water distributor is adapted to receive the personal cleaning device.

3. The douche toilet as set forth in claim 2, wherein the flushing water distributor has a receiver for the douche lance.

4. The douche toilet as set forth in claim 3, wherein the receiver comprises a slot for moveably seating the douche lance.

5. The douche toilet as set forth in claim 4, wherein the slot is inclined downwardly toward the toilet bowl.

6. The douche toilet as set forth in claim 1, wherein the flushing water distributor includes a connecting portion having a front-side deflector plate to laterally distribute the flushing water from the distributor.

7. The douche toilet as set forth in claim 1, further comprising a toilet seat fixed on a ceramic toilet pan, wherein the toilet seat includes an air opening to implement an air flow.

8. A flushing water distributor configured to be fitted into an inlet opening of a toilet bowl to distribute flushing water in a flushing chamber of the toilet bowl in a flushing operation, the flushing water inlet opening being the only opening for water inlet provided in the toilet bowl, and the flushing water distributor being adapted for fitment into the flushing water inlet opening, between the toilet bowl and a flushing pipe connector; the flushing water distributor comprising a hollow-cylindrical flushing water connection having a front end configured to be sealingly fitted into a rear side of the toilet bowl and a rear end configured to be connected to the flushing pipe connector, wherein the hollow-cylindrical flushing water connection comprises, at its front end, at least one flushing opening for distributing the flushing water; and the flushing water distributor having a douche lance housing integrated into the flushing water distributor and an extendable douche lance to effect a personal cleaning operation on a user of the toilet bowl, the douche lance being longitudinally displaceably received in the douche lance housing and being extendable from a retracted rest position into a cleaning position for the personal cleaning operation, wherein the douche lance is driven into the cleaning position by water pressure, against a compression spring situated in the douche lance housing, through an opening in a union nut inside the flushing chamber, and wherein the douche lance and the compression spring are completely removable forwardly from the douche lance housing after union nut removal.

9. The flushing water distributor as set forth in claim 8, further comprising a receiver for the douche lance.

10. The flushing water distributor as set forth in claim 9, wherein the receiver comprises a slot designed to be inclined downwardly toward the toilet bowl when the distributor is installed.

11. The flushing water distributor as set forth in claim 8, further comprising a connecting portion having a front-side deflector plate to laterally distribute the flushing water from the distributor.

12. A flushing water distributor to be fitted into a toilet bowl to distribute flushing water in a flushing chamber of the toilet bowl in a flushing operation, the flushing water distributor having an extendable douche lance integrated therein to effect a personal cleaning operation on a user of the toilet bowl, the douche lance being extendable from a retracted rest position into a cleaning position for the personal cleaning operation, a connecting portion having a front-side deflector plate to laterally distribute the flushing water from the distributor, and a shell-shaped distriution surface designed to direct the flushing water into the flushing chamber.

13. The flushing water distributor as set forth in claim 12, wherein the shell-shaped distribution surface is releasably connected to the flushing water distributor.

14. The flushing water distributor as set forth in claim 8, further comprising a separator for dividing flushing water flow.

15. The flushing water distributor as set forth in claim 14, wherein the separator includes at least one separating wall.

16. The flushing water distributor as set forth in claim 15, further comprising at least one water deflection device at a front end of the the at least one separating wall.

17. The flushing water distributor as set forth in claim 16, wherein the at least one water deflection device includes an inclined portion and/or curvature.

18. The flushing water distributor as set forth in claim 8, wherein the flushing water distributor is adapted for fitment into a flushing water inlet opening of the toilet bowl.

* * * * *